US009890460B2

(12) United States Patent
Klecka et al.

(10) Patent No.: US 9,890,460 B2
(45) Date of Patent: Feb. 13, 2018

(54) SELF-PEENING FEEDSTOCK MATERIALS FOR COLD SPRAY DEPOSITION

(71) Applicant: United Technologies Corporation, Hartford, CT (US)

(72) Inventors: Michael A. Klecka, Vernon, CT (US); Aaron T. Nardi, East Granby, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 32 days.

(21) Appl. No.: 15/023,253

(22) PCT Filed: Aug. 4, 2014

(86) PCT No.: PCT/US2014/049581

§ 371 (c)(1),
(2) Date: Mar. 18, 2016

(87) PCT Pub. No.: WO2015/047545

PCT Pub. Date: Apr. 2, 2015

(65) Prior Publication Data

US 2016/0258068 A1 Sep. 8, 2016

Related U.S. Application Data

(60) Provisional application No. 61/883,596, filed on Sep. 27, 2013.

(51) Int. Cl.

| | |
|---|---|
| ***C23C 24/04*** | (2006.01) |
| ***B24C 1/10*** | (2006.01) |
| ***B24C 1/00*** | (2006.01) |

(52) U.S. Cl.
CPC ..... *C23C 24/04* (2013.01); *B24C 1/003* (2013.01); *B24C 1/10* (2013.01)

(58) Field of Classification Search
CPC ..... C23C 24/04; B24C 1/003; B24C 1/10
USPC ..... 106/1.12; 75/53; 451/38
See application file for complete search history.

(56) References Cited

U.S. PATENT DOCUMENTS

| | | | | |
|---|---|---|---|---|
| 7,897,265 | B2 * | 3/2011 | Nardi | C23C 4/06 428/323 |
| 9,273,400 | B2 * | 3/2016 | Nardi | C23C 24/04 |
| 9,404,172 | B2 * | 8/2016 | Clavette | C23C 24/04 |
| 2003/0126800 | A1 | 7/2003 | Seth et al. | |
| 2003/0219542 | A1 * | 11/2003 | Ewasyshyn | C23C 24/04 427/180 |
| 2005/0132843 | A1 * | 6/2005 | Jiang | C23C 4/06 75/252 |
| 2006/0090593 | A1 | 5/2006 | Liu | |

(Continued)

FOREIGN PATENT DOCUMENTS

| | | | |
|---|---|---|---|
| EP | 2631323 | A1 | 8/2013 |
| JP | 2011025346 | A | 2/2011 |
| JP | 2012192463 | A | 10/2012 |

OTHER PUBLICATIONS

English Translation for JP2011-025346 Abstract, Feb. 2011.

(Continued)

*Primary Examiner* — Helene Klemanski
(74) *Attorney, Agent, or Firm* — Cantor Colburn LLP

(57) ABSTRACT

The invention provides a self-peening feedstock material for cold spray deposition comprising a higher ductility matrix material and a hardened particle.

11 Claims, 2 Drawing Sheets

Chrome-carbide + nickel chrome powder (light) within a nickel-chrome deposit.

(56) References Cited

U.S. PATENT DOCUMENTS

| | | | | |
|---|---|---|---|---|
| 2008/0145554 | A1 | 6/2008 | Ghasripoor et al. | |
| 2008/0152801 | A1 | 6/2008 | Debiccari et al. | |
| 2010/0304107 | A1* | 12/2010 | Nardi | C23C 24/04 428/217 |

OTHER PUBLICATIONS

English Translation for JP2012-192463 Abstract , Oct. 2012.
International Search Report for Application No. PCt/US2014/049581; dated Feb. 16, 2015.
Written Opinion for Application No. PCT/US2014/049581; dated Feb. 16, 2015.
European Search Report for European Application No. 14849412.3, dated May 22, 2017, 7 pages.
Lima et al., "Microstructural characteristics of cold-sprayed nanostructured WC-Co coatings", Thin Solid Films, vol. 416, 2002, pp. 129-135.

* cited by examiner

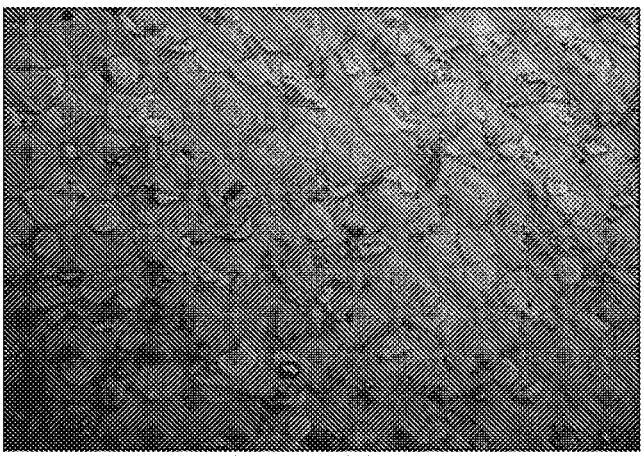
Figure 1: Chrome-carbide + nickel chrome powder (light) within a nickel-chrome deposit.

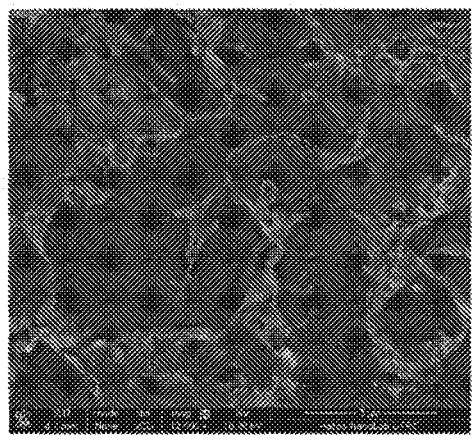
Figure 2: Individual chrome carbides within the chrome carbide powder.

SELF-PEENING FEEDSTOCK MATERIALS FOR COLD SPRAY DEPOSITION

RELATED APPLICATIONS

This application claims the benefit of and priority to U.S. Provisional Patent Application No. 61/883,596 filed Sep. 27, 2013, the contents of which are incorporated herein by reference in their entirety

BACKGROUND OF THE INVENTION

1. Field of the Invention

The present disclosure relates to a self-peening feedstock material for cold spray deposition.

2. Description of Related Art

Cold spray deposition is deposition/coating technique in which powdered materials are accelerated in a high velocity gas stream, directed at a substrate, and subsequently deposited upon impact. The coating results from the plastic deformation of the feedstock material during particle impact which results in a consolidation process.

Difficult to deposit materials frequently generate highly porous deposits during cold spray processing, resulting in degraded material properties. Spraying with helium gas can aid in densification by accelerating the feedstock powder to greater velocities; however, the cost of helium is substantially higher than more commonly used nitrogen gas.

Peening intensifies plastic deformation, improving densification. Therefore, increased densification can instead be achieved through careful selection of material systems which create a self-peening effect during deposition.

As such, a need exists for self-peening materials which provide effective coverage and densification through nitrogen based cold spray deposition.

SUMMARY OF THE INVENTION

In one aspect, the invention provides a self-peening feedstock material for cold spray deposition comprising a higher ductility matrix material and a hardened particle.

In one embodiment, the higher ductility matrix of the feedstock is a homogenous matrix material or a multiphase matrix material. In another embodiment, the higher ductility matrix is a metallic matrix material. In still other embodiments, the higher ductility matrix is a cobalt matrix material, a nickel matrix material, a nickel-chrome material, a cobalt-chrome material, or polymeric material.

In another embodiment, the hardened particle of the feedstock is a homogenous particle or a multiphase particle. In other embodiments, the hardened particle is a ceramic particle, a carbide particle, a silica particle, a diamond particle, a nanosteel particle, an iron particle, or a hardened organic polymer particle. In specific embodiments when a carbide particle is used, the carbide particle is a chrome-carbide particle, a chrome-carbide/nickel-chrome particle blend, or a tungsten-carbide particle.

In still another embodiment, the higher ductility matrix material is present in the feedstock from 5-95% by weight of the total composition of feedstock material. In certain embodiments, the higher ductility matrix material is present in the feedstock from 50-95% by weight of the total composition of feedstock material. In another embodiment, the hardened particle material in the feedstock is present from 5-95% by weight of the total composition of feedstock material. In another embodiment, the hardened particle material in the feedstock is present from 5-50% by weight of the total composition of feedstock material.

In yet another embodiment, the hardened particle material of the feedstock comprises particles having a particle size of 5 to about 500 μm. In another embodiment, the hardened particle material of the feedstock comprises substantially spherical particles or substantially amorphous particles. In still another embodiment, the hardened particle material comprises particles having a substantially nanocrystaline structure.

In a specific embodiment, the self-peening feedstock material for cold spray deposition of the invention comprises a nickel-chrome material as the higher ductility matrix and chrome-carbide nickel-chrome particles as the hardened particle material.

In another specific embodiment, the self-peening feedstock material for cold spray deposition of the invention comprises a cobalt matrix material as the higher ductility matrix and tungsten-carbide or tungsten-carbide-cobalt particles as the hardened particle material.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein:

FIG. 1 is an SEM micrograph depicting a coating comprising the self-peening material of the claimed invention; specifically, a coating comprising nickel chrome material and a chrome-carbide particle.

FIG. 2 is a higher magnification SEM micrograph of the material of FIG. 1 showing individual carbide particles within the final coating.

DETAILED DESCRIPTION

The materials of the invention utilize carefully selected material blends as feedstock for the cold spray coating/deposition techniques. These blends include a hardened particle phase (e.g., metal carbides, blends of metal carbides, and metal carbide cemented in a metallic binder) and a metal component in the form of a higher ductility matrix material. Because brittle fracture of hard materials during powder impact is detrimental to deposit quality, the hard phase is incorporated into a dense powder particle containing the hard phase and a tough binder material. These hard but tough agglomerate powder particles then work to peen the ductile metal matrix during impact. Without being limited by theory, it is believed that due to the dense agglomerated nature of the feedstock, and the fact that the higher toughness component allows for plastic deformation, brittle damage to the hardened particles is minimized during impact. Instead, the hard components enhance plastic deformation of the entire deposit during spraying. Further, through careful selection of materials there is significant chemical compatibility between the various materials, resulting in significantly improved bonding seen throughout the structure.

Definitions

As used herein the term "cold spray" refers to a materials deposition process in which relatively small particles (ranging in size, without limitation, from 5 to 500 micrometers (μm) in diameter) in the solid state are accelerated to high velocities (typically, but without limitation, 300 to 1200 meters/second), and subsequently develop a coating or deposit by impacting an appropriate substrate. Various terms—including "kinetic energy metallization," "kinetic metallization," "kinetic spraying," "high-velocity powder deposition," and "cold gas-dynamic spray method"—have been used to refer to this technique. In most instances, deformable powder particles in a gas carrier are brought to high velocities through introduction into a nozzle, designed to accelerate the gas. The subsequent high-velocity impact of the particles onto the substrate disrupts the oxide films on the particle and substrate surfaces, pressing their atomic structures into intimate contact with one another under momentarily high interfacial pressures and temperatures. Any pressurized gas can be used in the cold spray technique. In certain embodiments, the gas used is helium gas or nitrogen gas. In particular embodiments, the gas used is nitrogen gas.

As used herein, "homogenous," and in "homogenous matrix material" or "homogenous particles," means that the material is of uniform structure or composition.

As used herein, "multiphase," and in "multiphase matrix material" or "multiphase particles," means that the material is comprised of multiple materials and/or multiple phases of material which may be the same or different and which each provide particular properties to the ultimate coating.

As used herein, the term "substantially," as in "substantially spherical particles" or "substantially amorphous particles," means that the particles are largely uniform in shape such that they are spherical or amorphous. In certain instances, the spherical particles may be "highly spherical" such that there is a minimum of puckering on the surface of the particle. The shape of the particles used can be readily determined by one of ordinary skill in the art though observation using, for example, scanning electron microscopy.

Higher Ductility Matrix Material

As described herein, the feedstock of the claimed invention comprises a higher ductility matrix and a hardened particle component.

In one embodiment, the higher ductility matrix material of the feedstock is a homogenous matrix material or a multiphase matrix material.

In another embodiment, the higher ductility matrix is a metallic matrix material. In still other embodiments, the higher ductility matrix is a cobalt matrix material, a nickel matrix material, a nickel-chrome material, a cobalt-chrome material, or polymeric material. Other materials which could be utilized as the higher ductility material include, but are not limited to, aluminum (Al); copper (Cu); nickel (Ni); tantalum (Ta); commercially pure titanium (Ti); silver (Ag); zinc (Zn); stainless steel; nickel-base alloys; bondcoats, including, but not limited to MCrAlYs; metal-metal and metal-metal like composites, including, but not limited to copper-tungsten (Cu—W) or copper-Chromium; metal-carbides, including, but not limited to, aluminum-silicon carbide (Al—SiC); and metal-oxides, including, but not limited to, aluminum-alumina.

The amount of the higher ductility matrix material present in the feedstock is not limited and will be determined based on the type of coating to be deposited and the desired properties of the deposit. In general, the amount of the higher ductility matrix material present in the feedstock is from about 5-95% by weight of the total composition of feedstock material. In certain embodiments, the amount of the higher ductility matrix material present in the feedstock is, without limitation, from about 25-95%. In certain other embodiments, the amount of the higher ductility matrix material present in the feedstock is, without limitation, about 40-95%, about 50-95%, about 50-85%, about 50-75%, about 60-95% about 60-85%, or about 60-75% by weight of the total composition of feedstock material.

Hardened Particle Material

As described herein, the feedstock of the claimed invention comprises a higher ductility matrix and a hardened particle component.

In another embodiment, the hardened particle of the feedstock is a homogenous particle or a multiphase particle. In other embodiments, the hardened particle is a ceramic particle, a carbide particle, a silica particle, a diamond particle, a nanosteel particle, an iron particle, or a hardened organic polymer particle. In specific embodiments when a carbide particle is used, the carbide particle is a chrome-carbide particle, a nickel-chrome/chrome-carbide particle blend, or a tungsten-carbide particle.

The amount of the hardened particle material present in the feedstock is not limited and will be determined based on the type of coating to be deposited and the desired properties of the deposit. In general, the amount of the hardened particle material present in the feedstock is from about 5-95% by weight of the total composition of feedstock material. In certain embodiment, the amount of the hardened particle material present in the feedstock is, without limitation, from about 5-50%, about 10-50%, about 10-45%, about 15-50%, about 15-40%, about 20-50%, about 20-40%, about 20-30%, about 5-40%, or about 5-25% by weight of the total composition of feedstock material.

In yet another embodiment, the hardened particle material of the feedstock comprises particles having an average particle size of about 5 to about 500 μm. In certain embodiments, the particles have an average particle size about 5 to about 250 μm, about 5 to about 200 μm; about 5 to about 100 μm; about 25 to about 500 μm; about 50 to about 500 μm; or about 100 to about 500 μm.

In certain embodiments, the volume fraction of hardened particle material phase incorporated into the final deposit can be controlled by adjusting the powder size of the feedstock material. Specifically, certain large hard powders do not readily incorporate into a deposit. As such, in certain embodiments the hardened particle material may include particles of different sizes such that larger particles are added to the feedstock to increase plastic deformation via peening without increasing the amount of hardened particles in the final deposit, whereas smaller particles are added to the feedstock to be incorporated into the final deposit. Due to the chemical compatibility of the particles, contamination of the final deposit is reduced.

In another embodiment, the hardened particle material of the feedstock comprises substantially spherical particles or substantially amorphous particles. In still another embodiment, the hardened particle material comprises particles having a substantially nanocrystalline structure.

Specific Embodiments

Without limitation, a specific embodiment of the self-peening feedstock material for cold spray deposition of the invention comprises a nickel-chrome material as the higher ductility matrix and chrome-carbide-nickel-chrome dense particles as the hardened particle material.

Without limitation, another specific embodiment of the self-peening feedstock material for cold spray deposition of the invention comprises a cobalt matrix material as the higher ductility matrix is tungsten-carbide-cobalt particles as the hardened particle material.

In particular embodiments, the materials of the invention can be sprayed using standard techniques and equipment which will be known to one of ordinary skill in the art. In certain embodiments, the materials can be sprayed using, without limitation, nitrogen gas. Without limitation, the materials can be sprayed at a gas temperature of 800° C. gas temperature. In embodiments in which a blend of powders/particles are used, the materials can be either blended prior to spraying, or blended during spraying by using two separate powder feeders.

EXAMPLES

FIG. 1 is an SEM micrograph depicting a coating comprising the self-peening material of the claimed invention; specifically, a coating comprising nickel chrome material and a chrome-carbide-nickel-chrome particle. FIG. 2 is a higher magnification SEM micrograph of the material of FIG. 1 showing individual carbide particles within the final coating.

Each coating was prepared using a chrome-carbide-nickel chrome hard dense powder particle as the hardened particle and nickel-chrome material as the higher ductility matrix material. The deposit was prepared using nitrogen gas with a gas pressure of 40 bar\, and a gas temperature of 800° C.

What is claimed is:

1. A self-peening feedstock material for cold spray deposition comprising a higher ductility matrix material and a hardened particle material wherein the higher ductility matrix is a nickel-chrome material and the hardened particle material is a chrome-carbide nickel-chrome dense composite particle or the higher ductility matrix is a cobalt matrix material and the hardened particle material is a tungsten-carbide cobalt dense composite particle.

2. The self-peening feedstock material for cold spray deposition according to claim 1, wherein the higher ductility matrix material is a homogenous matrix material.

3. The self-peening feedstock material for cold spray deposition according to claim 1, wherein the higher ductility matrix material is a multiphase matrix material.

4. The self-peening feedstock material for cold spray deposition according to claim 1, wherein the hardened particle is a homogenous particle.

5. The self-peening feedstock material for cold spray deposition according to claim 1, wherein the hardened particle is a multiphase particle.

6. The self-peening feedstock material for cold spray deposition according to claim 1, wherein the higher ductility matrix material is present from 5-95% by weight of the total composition of feedstock material.

7. The self-peening feedstock material for cold spray deposition according to claim 1, wherein the hardened particle material is present from 5-95% by weight of the total composition of feedstock material.

8. The self-peening feedstock material for cold spray deposition according to claim 1, wherein the hardened particle material comprises particles having a particle size of about 5 to about 500 μm.

9. The self-peening feedstock material for cold spray deposition according to claim 1, wherein the hardened particle material comprises substantially spherical particles.

10. The self-peening feedstock material for cold spray deposition according to claim 1, wherein the hardened particle material comprises substantially amorphous particles.

11. The self-peening feedstock material for cold spray deposition according to claim 1, wherein the hardened particle material comprises particles having a substantially nanocrystalline structure.

* * * * *